US009142890B2

(12) United States Patent
Ko et al.

(10) Patent No.: US 9,142,890 B2
(45) Date of Patent: Sep. 22, 2015

(54) ANTENNA ASSEMBLY

(71) Applicant: FIH (Hong Kong) Limited, Kowloon (HK)

(72) Inventors: Cheng-Hung Ko, Shindian (TW); Hao-Ying Chang, Shindian (TW); Chih-Yang Tsai, Shindian (TW)

(73) Assignee: FIH (Hong Kong) Limited, Kowloon (HK)

( * ) Notice: Subject to any disclaimer, the term of this patent is extended or adjusted under 35 U.S.C. 154(b) by 169 days.

(21) Appl. No.: 13/730,869

(22) Filed: Dec. 29, 2012

(65) Prior Publication Data

US 2013/0241786 A1 Sep. 19, 2013

(30) Foreign Application Priority Data

Mar. 15, 2012 (TW) ..... 101108905 A

(51) Int. Cl.

| | |
|---|---|
| ***H01Q 1/38*** | (2006.01) |
| ***H01Q 13/10*** | (2006.01) |
| ***H01Q 1/24*** | (2006.01) |
| ***H01Q 1/48*** | (2006.01) |
| ***H01Q 9/04*** | (2006.01) |

(52) U.S. Cl.

CPC ..... *H01Q 13/106* (2013.01); *H01Q 1/243* (2013.01); *H01Q 1/38* (2013.01); *H01Q 1/48* (2013.01); *H01Q 9/0421* (2013.01)

(58) Field of Classification Search

USPC ..... 343/700 MS, 702, 767, 846

See application file for complete search history.

(56) References Cited

U.S. PATENT DOCUMENTS

| | | | | |
|---|---|---|---|---|
| 2004/0058723 | A1* | 3/2004 | Mikkola et al. | 455/575.7 |
| 2011/0001681 | A1* | 1/2011 | Hsu | 343/860 |
| 2012/0223864 | A1* | 9/2012 | Kerselaers | 343/700 MS |

* cited by examiner

*Primary Examiner* — Graham Smith

(74) *Attorney, Agent, or Firm* — Novak Druce Connolly Bove + Quigg LLP

(57) ABSTRACT

An antenna assembly includes a carrier, a metal sheet, and an antenna. The metal sheet is attached to the carrier and defining at least one notch. The antenna is connected to the metal sheet and includes a radio body for receiving and transmitting wireless signals. The radio body is positioned above the metal sheet. The length of current path in a peripheral wall of the at least one notch is in a predetermined proportion to the wavelength of the wireless signals, enabling the metal sheet to resonate with the radio body to increase the bandwidth of the antenna.

16 Claims, 4 Drawing Sheets

ANTENNA ASSEMBLY

BACKGROUND

1. Technical Field

The present disclosure relates to antenna assemblies.

2. Description of related art

Antennas are important elements of wireless communication devices, such as mobile phones. The bandwidth of the antennas is an important factor that affects the efficiency of receiving and transmitting signals of the antennas. However, structures of the antennas are limited by the interior space of the wireless communication devices. Thus, it is a great challenge to improve the bandwidth of antennas under the condition of not changing so much on the structures of the antennas.

Therefore, there is room for improvement within the art.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the disclosure. Moreover, in the drawings, like reference numerals designate corresponding parts throughout the views.

DETAILED DESCRIPTION

Figure 1:
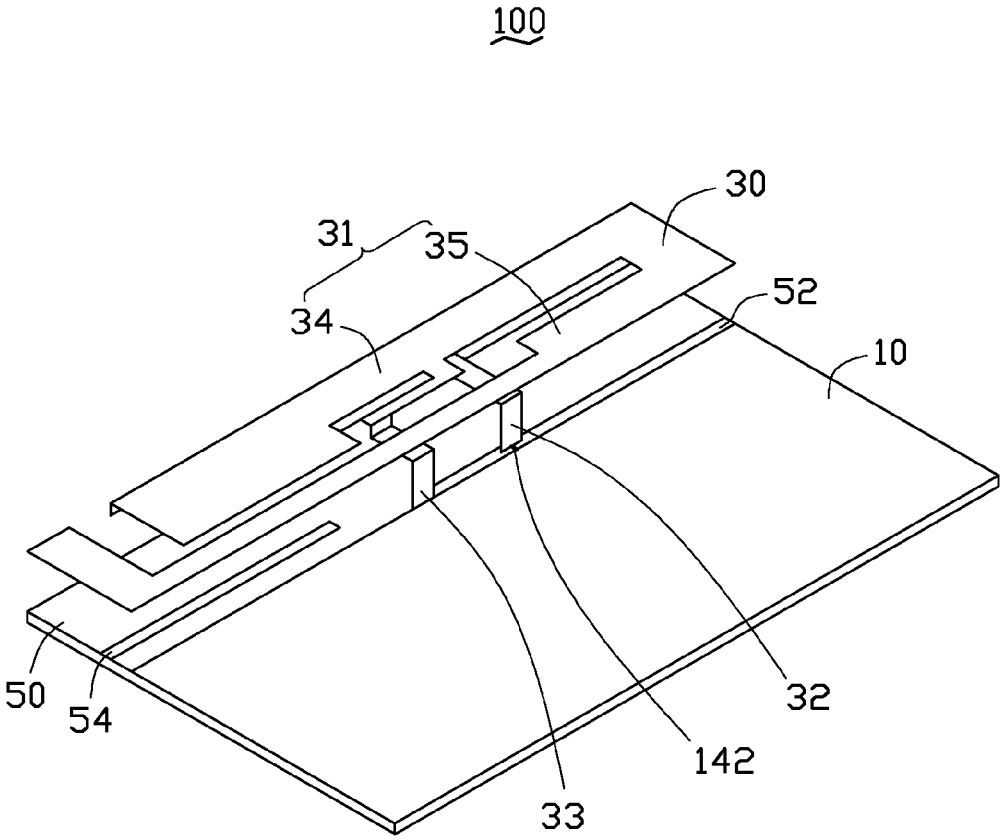
FIG. 1 is an assembled, isometric view of an antenna assembly in accordance with an exemplary embodiment.

FIG. 1 shows an antenna assembly 100 incorporated in a wireless communication device, such as a mobile phone or a personal digital assistant.

The antenna assembly 100 includes a carrier 10, an antenna 30, and a metal sheet 50. The antenna 30 and the metal sheet 50 both are attached to the carrier 10.

Figure 2:
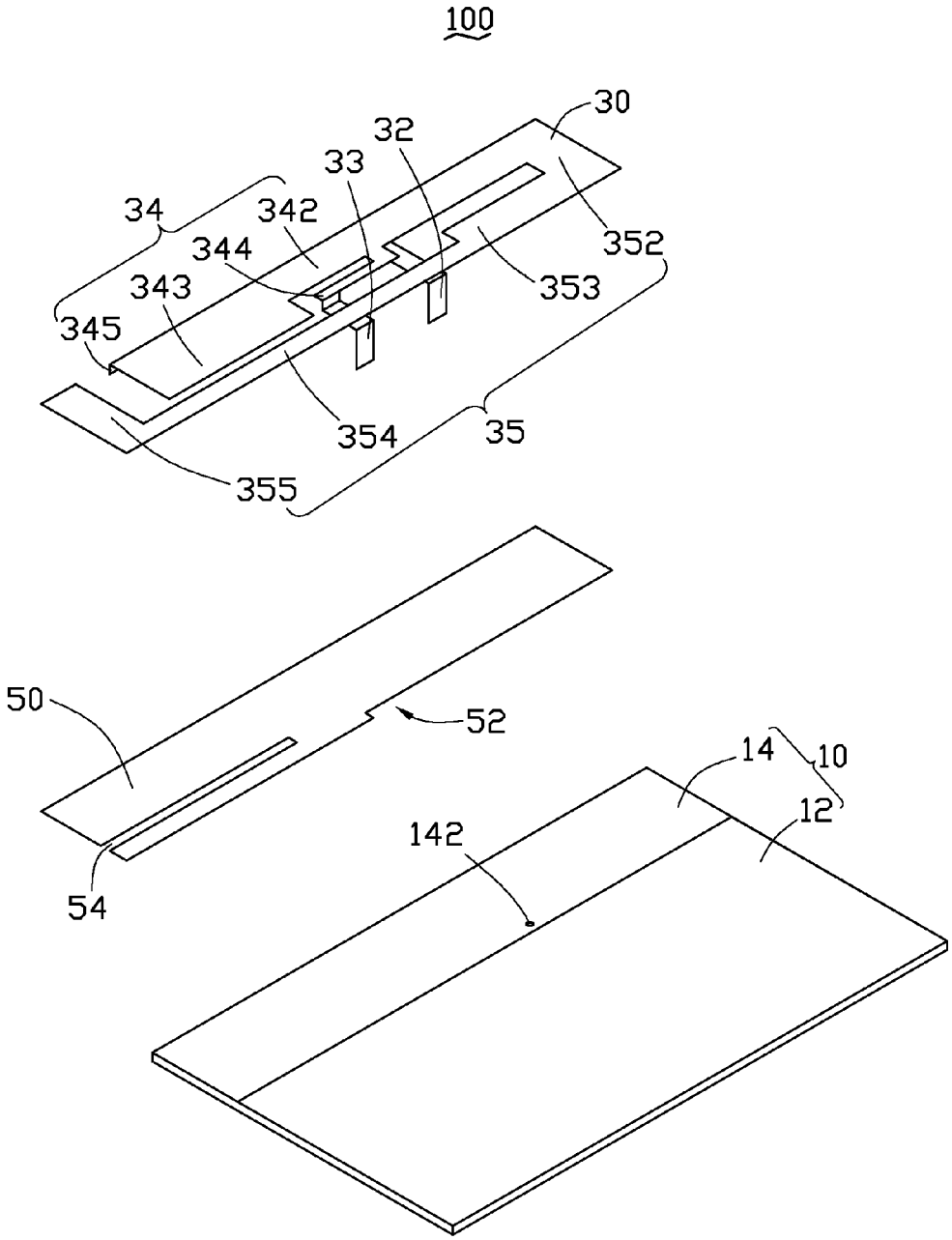
FIG. 2 is an exploded view of the antenna assembly of FIG. 1.
Figure 3:
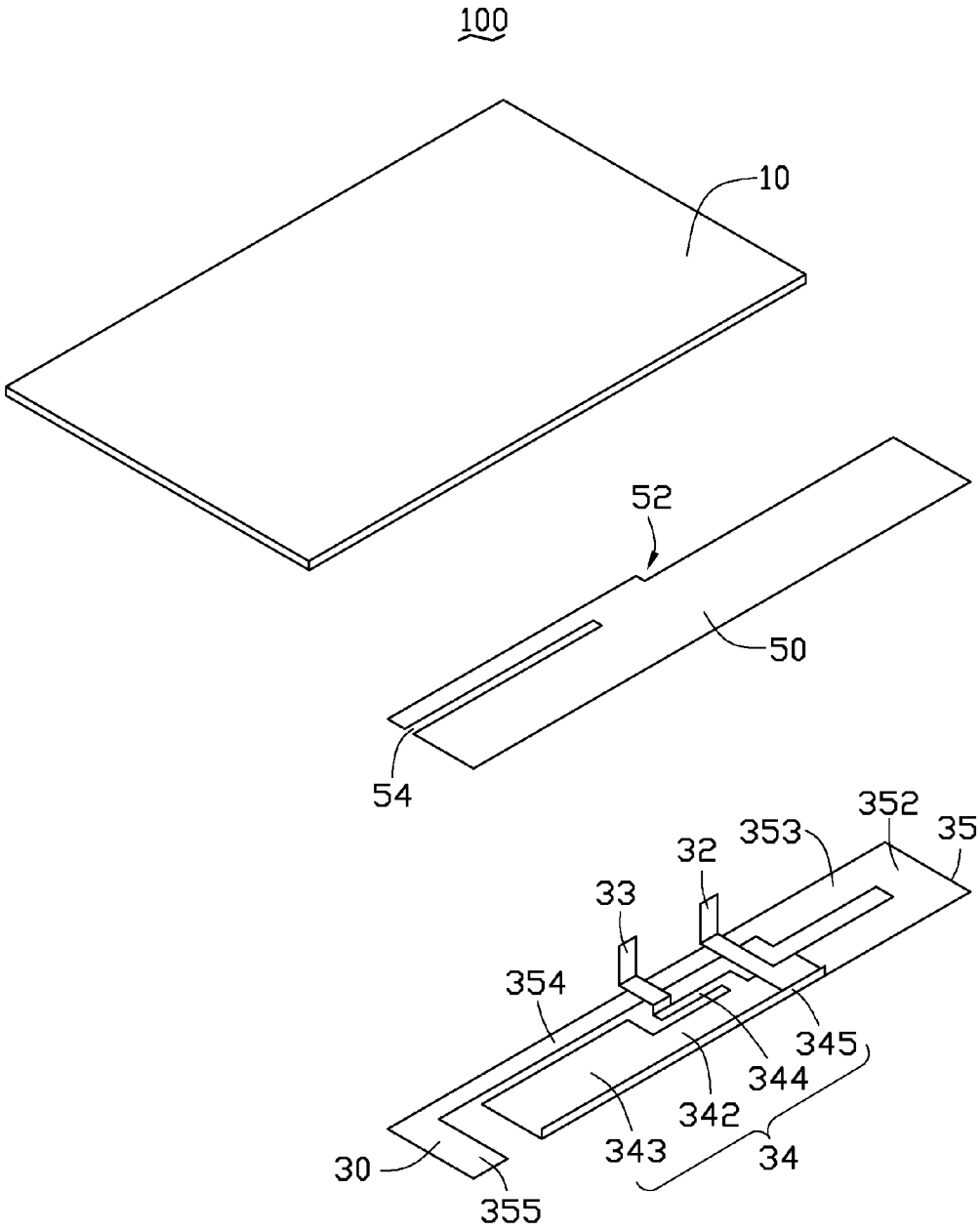
FIG. 3 is an exploded view of the antenna assembly of FIG. 1 viewed from another angle.

Referring to FIG. 2 and FIG. 3, the carrier 10 may be a printed circuit board of the wireless communication device incorporating the antenna assembly 100. The carrier 10 includes a grounding area 12, grounding the antenna assembly 100, and a clearance zone 14, adjacent to the grounding area 12. The clearance zone 14 can also be known in the art as a "keep out zone," and the like. The purpose of clearance zone 14 is to not permit other elements on the carrier 10 to be placed in a predetermined area to interfere the antenna 30. In the exemplary embodiment, the clearance zone 14 is located at an end of the carrier 10. The clearance zone 14 has a feed point 142 configured for feeding current into the antenna 30.

In the exemplary embodiment, the antenna 30 is a dual-band antenna. The antenna 30 is positioned opposite to the clearance zone 14. The antenna 30 includes a radiating body 31, a feed terminal 32, and a grounding terminal 33. The radiating body 31 includes a first radiating portion 34 and a second radiating portion 35.

The first radiating portion 34 includes a first main section 342, a second main section 343, a first extending section 344, and a second extending section 345. Both the first and second main sections 342, 343 are substantially rectangular. The second main section 343 connects with an end of the first main section 342 and has a width greater than the width of the first main section 342. The second main section 343 has a first edge aligned with a first edge of the first main section 342. The first extending section 344 is coplanar with the first and second main sections 342, 343. The first extending section 344 is substantially L-shaped. A first end of the first extending section 344 connects with a second edge of the first main section 342 opposite to the first edge of the first main section 342. A second end of the first extending section 344 extends perpendicularly from the first end and extends towards the second main section 343. The second extending section 345 extends from the first edge of the first main section 342 and the first edge of the second main section 343 and bends to be perpendicular to the first main section 342 (or the second main section 343). The first radiating portion 34 can be used to receive and transmit wireless signals having a first central frequency of about 1900 MHz.

The second radiating portion 35 is coplanar with the first main section 342 of first radiating portion 34. The second radiating portion 35 includes a first connecting section 352, a second connecting section 353, a third connecting section 354, and a forth connecting section 355. The first connecting section 352 extends perpendicularly from an end of the first main section 342 furthest from the second main section 343. The second connecting section 353 extends perpendicularly from the first connecting section 352 and extends towards the second main section 343. The third connecting section 354 connects with the second connecting section 353 and extends towards the second main section 343 to beyond the second main section 343. The forth connecting section 355 extends perpendicularly from the third connecting section 354. The second radiating portion 35 can be used to receive and transmit a second wireless signal having a central frequency of about 900 MHz.

The feed terminal 32 is substantially L-shaped. The feed terminal 32 extends perpendicularly from the second extending section 345 and extends towards the second radiating portion 35, and then bends towards the carrier 10, to electrically connect with the feed point 142 in the clearance zone 14. The grounding terminal 33 extends perpendicularly from the first extending section 344, and then bends towards the carrier 10, to electrically connect with the metal sheet 50.

The metal sheet 50 has a size substantially equal to the area of the clearance zone 14 and is attached to the clearance zone 14. The metal sheet 50 is electrically connected to the grounding area 12, to be a ground reference of the antenna 30. When the grounding terminal 33 is connected to the metal sheet 50, the metal sheet 50 grounds the antenna 30. The metal sheet 50 defines a first notch 52 and a second notch 54. The first notch 52 is defined at en edge proximate to the grounding area 12. When the metal sheet 50 is attached to the clearance zone 14, the feed point 142 is aligned with the first notch 52 to be exposed from the first notch 52. The second notch 54 is defined through an end of the metal sheet 50 and extends along a direction parallel to the first notch 52. The total length of the current path in a first notch peripheral wall of the first notch 52 and in a second notch peripheral wall of the second notch 54 is in a predetermined proportion to the wavelength of the signals received and transmitted by the first radiating portion 34. Thus, the metal sheet 50 resonates with the first radiating portion 34 to increase the bandwidth of the high frequency band (e.g., 1900 MHz band).

When electrical current flows in the feed terminal 32, the radiating body 31, the grounding terminal 33, the metal sheet 50, and the grounding area 12, to form a current loop, the antenna assembly 100 receives and transmits the first wireless signal having a high frequency and the second wireless signal having a low frequency. In this case, a current is induced in the metal sheet 50. The existence of the first and second notches 52, 54 enables the induced current in the metal sheet 50 to couple with current in the first radiating portion 34, thus enabling the metal sheet 50 to resonate with the first radiating portion 34.

Figure 4:
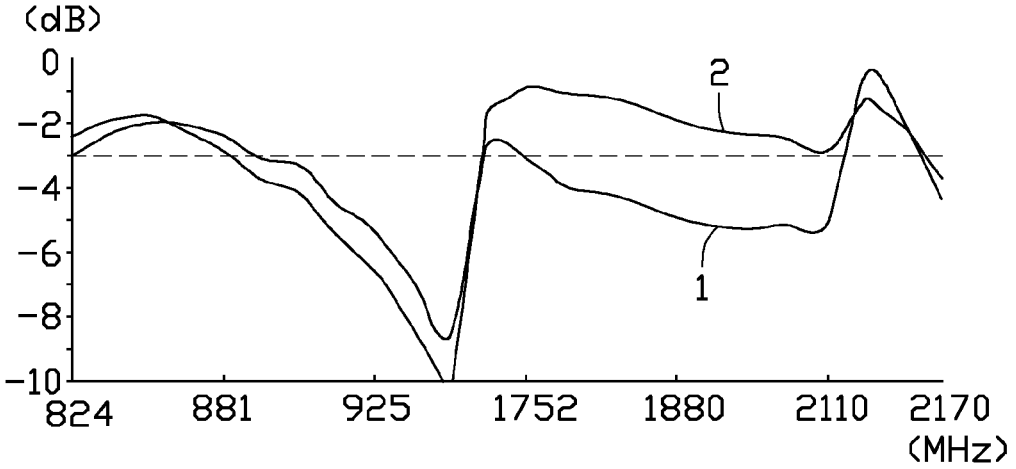
FIG. 4 is a return loss graph of the antenna assembly of FIG. 1.

Referring to FIG. 4, the curve 2 shows a return loss (RL) graph of the antenna assembly 100 without the metal sheet 50. The curve 1 shows a RL graph of the antenna assembly 100 having the metal sheet 50 defining the first and second notches 52, 54. It is shown that the antenna assembly 100 with the metal sheet 50 defining the first and second notches 52, 54 has an obvious increased bandwidth of the high frequency band.

The antenna 30 is not limited to a dual-band antenna. The antenna 30 can also be a single band antenna or multi-band antenna. Correspondingly, the antenna 30 is not limited to the structure described above.

The metal sheet 50 can also have only the first notch 52 or the second notch 54. Furthermore, the shapes of the first notch 52 and the second notch 54 can also be changed, as long as the notch(es) defined on the metal sheet 50 has a peripheral wall length in a predetermined proportion to the wavelength of signals which need an increase in bandwidth.

The antenna assembly 100 has the metal sheet 50 attached to the clearance zone 14 of the carrier 10. The metal sheet 50 defines the first and second notches 52, 54, enabling the metal sheet 50 to be cable of the antenna 30, thus increasing the bandwidth of the antenna 30 and improving the efficiency of receiving and transmitting signals of the antenna 30. Furthermore, the metal sheet 50 is positioned on the clearance zone 14 of the carrier 10, effectively utilizing the clearance zone 14 and occupying no extra space of the carrier 10 or the wireless communication device incorporating the antenna assembly 100.

It is to be understood, however, that even through numerous characteristics and advantages of the present disclosure have been set forth in the foregoing description, together with details of assembly and function, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. An antenna assembly, comprising:

a carrier;

a metal sheet, the metal sheet is attached to the carrier and defines at least one notch; and an antenna, the antenna is connected to the metal sheet and comprises a feed terminal, a grounding terminal, and a radiating body for receiving and transmitting wireless signals, the radiating body is positioned above the metal sheet; the radiating body comprising a first radiating portion and a second radiating portion, the first radiating portion comprising at least one main section, a first extending section, and a second extending section;

wherein length of current path in a peripheral wall of the at least one notch is in a predetermined proportion to the wavelength of the wireless signals, enabling the metal sheet to resonate with the radiating body;

the first extending section and the at least one main section are coplanar, the second extending section is perpendicular to the at least one main section; the feed terminal perpendicularly extends from the second extending section and parallel to the at least one main section, and then extends towards the second radiating portion, and then bends towards the carrier; the grounding terminal perpendicularly extends from the first extending section, and perpendicularly bends towards the second radiating portion, and then perpendicularly bends towards the carrier.

2. The antenna assembly as claimed in claim 1, wherein the carrier comprises a clearance zone; and the metal sheet is attached to the clearance zone.

3. The antenna assembly as claimed in claim 2, wherein the carrier comprises a grounding area for grounding the antenna; and the metal sheet is electrically connected to the grounding area.

4. The antenna assembly as claimed in claim 3, wherein the carrier has a feed point; and the feed terminal is electrically connected to the feed point.

5. The antenna assembly as claimed in claim 4, wherein the feed point is located in the clearance zone and is aligned with the at least one notch, thus the feed point is uncovered by and is accessible via the at least one notch.

6. The antenna assembly as claimed in claim 3, wherein the grounding terminal is electrically connected to the metal sheet.

7. The antenna assembly as claimed in claim 1, wherein the first radiating portion is configured for receiving and transmitting wireless signals having a first central frequency and the second radiating portion is configured for receiving and transmitting wireless signals having a second central frequency; and the length of current path in the peripheral wall of the at least one notch is in a predetermined proportion to the wavelength of the wireless signals having the first central frequency.

8. An antenna assembly, comprising:

a carrier;

a metal sheet, the metal sheet is attached to the carrier and defines a first notch and a second notch; and an antenna positioned opposite to the metal sheet, the antenna comprises a feed terminal, a grounding terminal, a first radiating portion for receiving and transmitting wireless signals having a first central frequency and a second radiating portion for receiving and transmitting wireless signals having a second central frequency;

wherein a total length of current path in a first notch peripheral wall of the first notch and in a second notch peripheral wall of the second notch is in a predetermined proportion to the wavelength of the wireless signals having the first central frequency, enabling the metal sheet to resonate with the first radiating portion;

wherein the first extending section and the at least one main section are coplanar, the second extending section is perpendicular to the at least one main section; the feed terminal perpendicularly extends from the second extending section and parallel to the at least one main section, and then extends towards the second radiating portion, and then bends towards the carrier; the grounding terminal perpendicularly extends from the first extending section, and perpendicularly bends towards the second radiating portion, and then perpendicularly bends towards the carrier.

9. The antenna assembly as claimed in claim 8, wherein the carrier comprises a clearance zone; and the metal sheet is attached to the clearance zone.

10. The antenna assembly as claimed in claim 9, wherein the carrier comprises a grounding area for grounding the antenna; and the metal sheet is electrically connected to the grounding area.

11. The antenna assembly as claimed in claim 10, wherein the carrier has a feed point; and the feed terminal is electrically connected with the feed point.

12. The antenna assembly as claimed in claim 11, wherein the feed point is located in the clearance zone and is aligned with the first notch, thus the feed point is uncovered by and is accessible via the first notch.

13. The antenna assembly as claimed in claim 10, wherein grounding terminal electrically connects with the metal sheet.

14. The antenna assembly as claimed in claim 10, wherein the first notch is defined at an edge proximate to the grounding area; and the second notch is defined through an end of the metal sheet and extends along a direction parallel to the first notch.

15. The antenna assembly as claimed in claim 14, wherein the first radiating portion comprises a first main section and a second main section; the second main section connects with an end of the first main section; a first end of the first extending section connects with the first main section; a second end of the first extending section extends perpendicularly from the first end and extends towards the second main section; the second extending section connects with a same side of the first main section and the second main section and bends to be perpendicular to the first main section.

16. The antenna assembly as claimed in claim 15, wherein the second radiating portion comprises a first connecting section, a second connecting section, a third connecting section, and a fourth connecting section; the first connecting section connects with the first main section; the second connecting section extends perpendicularly from the first connecting section and extends towards the second main section; the third connecting section connects with the second connecting section and extends towards the second main section to beyond the second main section; the fourth connecting section extends perpendicularly from the third connecting section.

* * * * *